US010865506B2

(12) United States Patent
Mathews

(10) Patent No.: US 10,865,506 B2
(45) **Date of Patent: *Dec. 15, 2020**

(54) YARN FEED ROLL DRIVE SYSTEM FOR TUFTING MACHINE

(71) Applicant: Card-Monroe Corp., Chattanooga, TN (US)

(72) Inventor: Ricky E. Mathews, Sale Creek, TN (US)

(73) Assignee: Card-Monroe Corp., Chattanooga, TN (US)

( * ) Notice: Subject to any disclaimer, the term of this patent is extended or adjusted under 35 U.S.C. 154(b) by 200 days.

This patent is subject to a terminal disclaimer.

(21) Appl. No.: 16/114,763

(22) Filed: Aug. 28, 2018

(65) Prior Publication Data

US 2018/0363186 A1 Dec. 20, 2018

Related U.S. Application Data

(63) Continuation of application No. 14/296,713, filed on Jun. 5, 2014, now Pat. No. 10,072,368.

(51) Int. Cl.

| | |
|---|---|
| ***D05C 15/18*** | (2006.01) |
| ***D05B 69/12*** | (2006.01) |
| ***D05C 15/26*** | (2006.01) |

(52) U.S. Cl.

CPC ..... *D05C 15/18* (2013.01); *D05B 69/12* (2013.01); *D05C 15/26* (2013.01)

(58) Field of Classification Search

CPC ..... D05C 15/04; D05C 15/16; D05C 15/18; D05B 69/12

See application file for complete search history.

(56) References Cited

U.S. PATENT DOCUMENTS

| | | | |
|---|---|---|---|
| 2,842,259 | A | 7/1958 | Hoeselbarth |
| 2,862,465 | A | 12/1958 | Card |

(Continued)

FOREIGN PATENT DOCUMENTS

| | | |
|---|---|---|
| GB | 1363974 | 7/1972 |
| GB | 2002040 | 7/1978 |

(Continued)

OTHER PUBLICATIONS

Extended European Search Report for related Application No. 15803555.0-1018 / 3152351 // Patent No. PCT/US2015/034549, dated Jan. 22, 2018.

(Continued)

*Primary Examiner* — Nathan E Durham

(74) *Attorney, Agent, or Firm* — Womble Bond Dickinson (US) LLP

(57) ABSTRACT

A yarn feed system, for control of the feeding of one or more yarns to the needles of a tufting machine, which can be manufactured as a substantially standardized unit or attachment removably mounted to a tufting machine includes a series of yarn feed devices each having a drive motor with a replaceable yarn feed roll drive system mounted thereto. Each yarn feed roll drive system can include a set or series of yarn feed rolls mounted within a housing and having a series of gear teeth formed thereabout, with the gear teeth of the yarn feed rolls engaged in an intermeshing arrangement so that as one of the yarn feed rolls is driven by the drive motor, the other yarn feed rolls likewise are actively driven thereby. Each of the yarn feed rolls further will include a textured roll surface that can provide for enhanced grip and control of the feeding of the yarns which are extended thereabout to the needles of the tufting machine in accordance with a tufted pattern being formed.

15 Claims, 5 Drawing Sheets

(56) References Cited

U.S. PATENT DOCUMENTS

| | | | |
|---|---|---|---|
| 2,866,424 | A | 12/1958 | Masland, II |
| 2,884,881 | A | 5/1959 | Oberholtzer |
| 2,932,181 | A | 4/1960 | MacCaffray, Jr. |
| 2,966,866 | A | 1/1961 | Card |
| 3,067,701 | A | 12/1962 | Wilcox |
| 3,075,482 | A | 1/1963 | Card |
| 3,095,840 | A | 7/1963 | Ballard |
| 3,095,841 | A | 7/1963 | Ballard et al. |
| 3,103,903 | A | 9/1963 | Broadrick et al. |
| 3,112,721 | A | 12/1963 | Oberholtzer et al. |
| 3,221,683 | A | 12/1965 | Abelsma |
| 3,605,660 | A | 9/1971 | Short |
| 3,752,094 | A | 8/1973 | Short |
| 3,847,098 | A | 11/1974 | Hammel, Jr. |
| 3,895,355 | A | 7/1975 | Shorrock |
| 3,906,876 | A | 9/1975 | Fittoa |
| 3,943,865 | A | 3/1976 | Short et al. |
| 4,077,164 | A | 3/1978 | Peterman, Jr. |
| 4,127,078 | A | 11/1978 | Spanel et al. |
| 4,193,158 | A | 3/1980 | Woodcock |
| 4,221,317 | A | 9/1980 | Fukada et al. |
| 4,244,309 | A | 1/1981 | Spanel et al. |
| 4,245,794 | A | 1/1981 | Hasegawa et al. |
| 4,267,787 | A | 5/1981 | Fukada |
| 4,285,285 | A | 8/1981 | Chambers et al. |
| 4,317,419 | A | 3/1982 | Spanel et al. |
| 4,366,761 | A | 1/1983 | Card |
| 4,393,793 | A | 7/1983 | Beasley |
| 4,469,037 | A | 9/1984 | Bost, Jr. |
| 4,519,332 | A | 5/1985 | Fukada |
| 4,549,496 | A | 10/1985 | Kile |
| 4,608,935 | A | 9/1986 | Bardsley |
| 4,619,212 | A | 10/1986 | Card et al. |
| 4,688,497 | A | 8/1987 | Card et al. |
| 4,829,917 | A | 5/1989 | Morgante et al. |
| 4,856,104 | A | 8/1989 | Stoll et al. |
| 4,856,441 | A | 8/1989 | Kurata |
| 4,864,946 | A | 9/1989 | Watkins |
| 4,867,080 | A | 9/1989 | Taylor et al. |
| 4,870,915 | A | 10/1989 | Bagnall |
| 4,981,091 | A | 1/1991 | Taylor et al. |
| 5,005,498 | A | 4/1991 | Taylor et al. |
| 5,058,518 | A | 10/1991 | Card et al. |
| 5,080,028 | A | 1/1992 | Ingram |
| 5,094,178 | A | 3/1992 | Watkins |
| 5,182,997 | A | 2/1993 | Bardsley |
| 5,205,233 | A | 4/1993 | Ingram |
| 5,285,821 | A | 2/1994 | Fredriksson |
| 5,288,556 | A | 2/1994 | Lemelson |
| 5,353,582 | A | 10/1994 | Citterio et al. |
| 5,383,415 | A | 1/1995 | Padgett, III |
| 5,458,075 | A | 10/1995 | Tice et al. |
| 5,461,996 | A | 10/1995 | Kaju |
| 5,526,760 | A | 6/1996 | Ok |
| 5,544,064 | A | 8/1996 | Beckwith |
| 5,544,605 | A | 8/1996 | Frost |
| 5,549,064 | A | 8/1996 | Padgett, III |
| 5,575,228 | A | 11/1996 | Padgett, III et al. |
| 5,588,383 | A | 12/1996 | Davis et al. |
| 5,622,126 | A | 4/1997 | Card et al. |
| 5,662,054 | A | 9/1997 | Bardsley |
| 5,738,030 | A | 4/1998 | Ok |
| 5,743,200 | A | 4/1998 | Miller et al. |
| 5,743,201 | A | 4/1998 | Card et al. |
| 5,806,446 | A | 9/1998 | Morrison et al. |
| 5,983,815 | A | 11/1999 | Card |
| 6,009,818 | A | 1/2000 | Card et al. |
| 6,202,580 | B1 | 3/2001 | Samilo |
| 6,213,036 | B1 | 4/2001 | Slattery |
| 6,244,203 | B1 | 6/2001 | Morgante et al. |
| 6,283,053 | B1 | 9/2001 | Morgante et al. |
| 6,439,141 | B2 | 8/2002 | Morgante et al. |
| 6,516,734 | B1 | 2/2003 | Morgante et al. |
| 6,550,407 | B1 | 4/2003 | Frost et al. |
| 6,651,572 | B2 | 11/2003 | Bennett et al. |
| 6,725,789 | B1 | 4/2004 | Hall |
| 6,807,917 | B1 | 10/2004 | Christman et al. |
| 6,834,601 | B2 | 12/2004 | Card et al. |
| 6,877,449 | B2 | 4/2005 | Morgante et al. |
| 6,945,184 | B2 | 9/2005 | Frost et al. |
| 7,073,695 | B1 | 7/2006 | Haselwander |
| 7,089,874 | B2 | 8/2006 | Morgante et al. |
| 7,685,952 | B2 | 3/2010 | Frost et al. |
| 7,905,187 | B2 | 3/2011 | Card et al. |
| 8,201,509 | B2 | 6/2012 | Christman, Jr. |
| 8,443,743 | B2 | 5/2013 | Christman, Jr. |
| 2002/0037388 | A1 | 3/2002 | Morgante et al. |
| 2004/0025767 | A1 | 2/2004 | Card et al. |
| 2005/0056197 | A1 | 3/2005 | Card et al. |
| 2005/0204975 | A1 | 9/2005 | Card et al. |
| 2011/0048305 | A1 | 3/2011 | Christman, Jr. |
| 2012/0325134 | A1 | 12/2012 | Beatty et al. |
| 2013/0180440 | A1 | 7/2013 | Hall |

FOREIGN PATENT DOCUMENTS

| | | | |
|---|---|---|---|
| GB | 2002828 | | 7/1978 |
| GB | 2186297 | | 1/1987 |
| JP | 2003/089963 | A | 3/2003 |
| WO | WO2001/059195 | A2 | 8/2001 |
| WO | WO2004/057084 | A2 | 7/2004 |

OTHER PUBLICATIONS

Supplementary Partial European Search Report for related Application No. 15803555.0-1710 / 3152351 // Patent No. PCT/US2015/034549, dated Oct. 17, 2017.

YARN FEED ROLL DRIVE SYSTEM FOR TUFTING MACHINE

CROSS REFERENCE TO RELATED APPLICATIONS

The present Patent Application is a Continuation of co-pending U.S. patent application Ser. No. 14/296,713, filed Jun. 5, 2014. The specification and drawings of the Patent Application referenced above are specifically incorporated herein by reference as if set forth in their entireties.

FIELD OF THE INVENTION

The present invention generally relates to tufting machines, and in particular to drive systems such as for the yarn feed rolls of a yarn feed system or pattern attachment of a tufting machine.

BACKGROUND OF THE INVENTION

In the market for tufted articles such carpet, there has been a substantial demand placed on the development of new production of new and innovative carpet patterns or styles to keep up with changing consumer tastes and increased competition in the market place. Control systems have now been developed for tufting machines that enable greater precision and variety in the design and production of tufted patterned carpets and other articles. For example, U.S. Pat. Nos. 8,141,505 and 8,359,989 disclose yarn placement and/or stitch distribution control systems for controlling the operation of a tufting machine to enable the placement of desired stitches or tufts of yarn, including selected colors or types of yarns, within a pattern being tufted into a backing material with enhanced precision, enabling a variety of patterned visual effects to be formed. Controls for yarn feed mechanisms or pattern attachments, such as single or double end yarn feed controls for controlling the feeding of 1-2 yarns to the needles of a tufting machine, further have been developed to provide control of individual yarns fed to each of the needles of the tufting machine. Such single or double end yarn feed attachments typically include a number of drive motors each driving a series of yarn feed rolls through which one or two ends of yarns can be fed to provide more individualized control of the feeding of the yarns to needles.

While such single or double end yarn feed mechanisms can provide more individualized control of each of the yarns being fed to the needles of a tufting machine, they typically are more expensive than standard yarn feed mechanisms or attachments. In addition, it is important that the yarn feed rolls of such systems be able to consistently feed the yarns over a desired useful life. As the yarn feed rolls are operated, however, they can be subjected to friction and other forces as the yarns pass thereover, which cause the rolls to become worn, which, in turn, can allow the yarns to slip or otherwise can result in a loss of control of the feeding of the yarns, generally requiring replacement of the yarn feed rolls. When such yarn feed rolls need to be replaced, the operation of the tufting machine typically will need to be halted, and individual yarn feed drives and/or devices often must be removed to enable access and replacement of the worn yarn feed rolls.

Accordingly, it can be seen that a need exists for a drive system such as for the yarn feed of a tufting machine that addresses the foregoing and other related and non-related problems in the art.

SUMMARY OF THE INVENTION

Briefly described, the present invention generally relates to a drive system for a tufting machine, and in particular to a yarn feed roll drive system or assembly for a yarn feed mechanism or pattern yarn feed attachment adapted to feed one or more yarns to selected needles of a tufting machine. For example, the yarn feed roll drive system can be incorporated as part of a yarn feed system or pattern attachment feeding single or double ends of yarns individually to the needles of the tufting machine as the needles are reciprocated into a backing material to form tufts of yarns in the backing material in a desired pattern. The yarn feed roll drive system also can be used in other types of pattern attachments or yarn feed systems, such as roll, scroll or other yarn feed mechanisms or attachments feeding multiple yarns to selected needles spaced across the tufting machine, such as for forming tufted patterns having one or more pattern repeats defined across a backing material moving through the tufting machine.

In one embodiment, the yarn feed roll drive system can comprise an assembly or unit that can be removably mounted within a yarn feed unit or pattern attachment, as a component or part of each of a series of yarn feed devices feeding a desired number of yarns to selected needles of the tufting machine. Each yarn feed device generally can include a drive motor mountable within a frame of the yarn feed unit or attachment and which is controlled by a yarn feed controller, that can be integrated with the motor or which can be part of a control system for the tufting machine, with one or more yarn feed controllers each controlling the motors of a series of yarn feed devices. The yarn feed controllers can control the operation of their associated yarn feed drive motors for feeding the yarns through the yarn feed devices at desired rates and/or amounts to selected needles of the tufting machine as needed to form the desired or programmed pattern.

The yarn feed roll drive system or assembly of each yarn feed device generally can be mounted in an operative or driven relationship with its associated drive motor so as to form an integrated yarn feed device. Each yarn feed roll drive system further can include a housing received and/or releasably mounted over a forward or operative end of the drive motor, with a drive shaft of drive motor extending therethrough, and with one or more yarn delivery openings formed in the housing and receiving one or more yarns therethrough. A series or set of yarn feed rolls, for example, in one embodiment, three yarn feed rolls, can be rotatably mounted to the housing, with the forward body portions of the yarn feed rolls of each set in a spaced-apart arrangement, substantially out of contact with each other. Yarn guide tubes also can be mounted over the yarn delivery openings of the housing to direct the yarns toward the yarn feed rolls, with the yarns being received and extended about the feed rolls so as to be pulled or fed therebetween for the feeding the one or more yarns to selected ones of the needles of the tufting machine.

The yarn feed rolls can be formed as substantially unitary or one-piece structures or can include a series of components combined into an assembly. In one embodiment, each of the yarn feed rolls can comprise injection molded or extruded rollers formed of a lightweight, high strength plastic, composite or synthetic material, with each yarn feed roll including a body having a first, proximal or drive end and a second, distal or feed end. A gear such as a spur, helical, spiral or other type of gear or sprocket having a series of radially projecting teeth can be formed at or about the body of each yarn feed roll adjacent the drive ends thereof, or can be formed separately and mounted to each yarn feed roll. In addition, the bodies of the yarn feed rolls further generally will include textured roll surfaces configured to provide increased traction or grip for pulling the yarns therebetween. The textured roll surfaces of each of the yarn feed rolls can be replaceable, and can be formed by applying a coating or paint or by fitting a strip, tube or sleeve along the bodies of the yarn feed rolls, or by forming the textured surfaces of the yarn feed rolls during extrusion or molding thereof. In one example embodiment, a Trizact™ diamond tile coating material, produced by 3M Corporation, can be used, while in other embodiments, emery paper or other abrasive/grit material sleeves, carriers or wrappings, metalized arc spray materials or thermal spray coatings, and/or other tacky or textured gripping materials, also can be used.

The housing for each yarn feed roll drive system can be injection-molded or extruded, for example using the same plastic, composite or synthetic material as the yarn feed rolls, and further can be configured along a rear or drive side thereof to receive and releasably engage its corresponding drive motor, being mounted thereto such as by releasable fasteners. Thus, the yarn feed roll drive system housing and set of yarn feed rolls thereof can be removed as a unit, without necessarily having to remove the entire yarn feed device from the yarn feed unit or attachment. The yarn feed rolls also generally can be removably received within recesses or openings formed in a front surface of the housing, generally being arranged in a staggered or offset arrangement with their gear teeth engaging and intermeshing with each other. The arrangement and/or configuration of the yarn feed rolls further generally is designed to provide multiple points and/or a substantially increased area of contact (i.e., about 90°-180° or more) between the yarns and the textured roll surfaces to enable enhanced control of the feeding of the yarns. The yarn feed rolls also can be substantially rigidly mounted within the housing, without having to be biased or urged into contact with each other for driving of the rolls, or for engaging and pulling the yarns therebetween. For example, at least one of the yarn feed rolls can include a connector or bushing extending from the drive side thereof and which is adapted to engage and receive the drive shaft of the drive motor for driving the yarn feed rolls, while the other yarn feed drive rolls can be rotatably mounted within the housing by bushings or axles extended therethrough.

During operation, the drive motor of each yarn feed device will drive at least one of the yarn feed rolls, with the remaining yarn feed rolls being driven by the engagement of their gear teeth with the driven yarn feed rolls. As the yarn feed rolls are rotated, the yarns fed therebetween will be engaged and directed to selected needles of the tufting machine for formation of tufts of yarns within the backing material passing through the tufting machine. The configuration and structure of the present yarn feed roll drive system enables controlled feeding of the yarns thereby, as well as the efficient removal and replacement of the yarn feed rolls of each of the yarn feed devices individually and/or as a unit with the removal of the housing, without requiring removal of the entire yarn feed device, including the drive motors thereof, in order to change-out or replace individual rollers. In addition, the sizing and spacing of the yarn feed rolls of the yarn feed drive system further can be varied for feeding different sizes, numbers or types of yarns, or as needed for other applications, and in at least one embodiment, the yarn feed rolls can be provided with removable and/or replaceable textured surface coverings.

Various objects, features and advantages of the present invention will become apparent to those skilled in the art upon a reading of the following detailed description, when taken in conjunction with accompanying drawings.

Figure 1A:
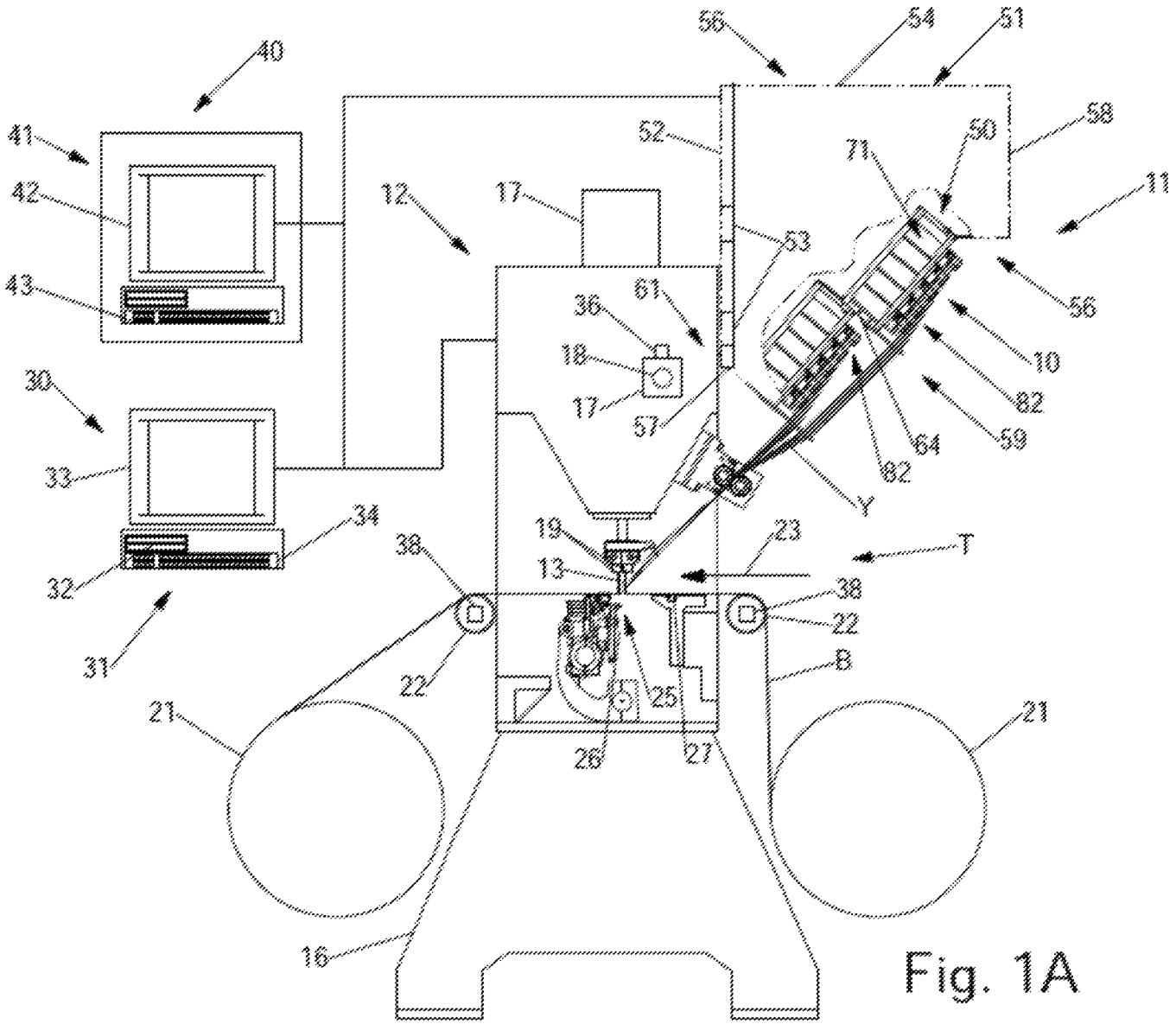
FIGS. 1A-1B schematically illustrate a tufting machine including a yarn feed system or pattern attachment including the yarn feed roll drive system according to the principles of the present invention.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments and/or features of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION

Referring now in greater detail to the drawings in which like numerals indicate like parts throughout the several views, FIGS. 1A-5 generally illustrate one embodiment of a drive system 10 such as for use as part of a yarn feed system or yarn feed pattern attachment 11 of a tufting machine 12 (FIGS. 1A, 1B) for controlling the feeding of individual yarns Y to the needles 13 of the tufting machine 12. For example, the drive system can comprise a yarn feed roll drive system or assembly 10 that can be incorporated into a yarn feed attachment such as an Infinity or Infinity IIE yarn feed system or pattern attachment, as manufactured by Card-Monroe Corp., which is adapted to control feeding of one or more yarns to selected ones of the needles 13 of the tufting machine to enable greater precision and control in the formation of tufts of yarn in a backing material B passing through a tufting zone T of the tufting machine and beneath the needles 13 in order to form programmed or desired carpet patterns. Other types of yarn feed systems or attachments, including attachments feeding multiple series of yarns, also can be used.

Figure 1B:
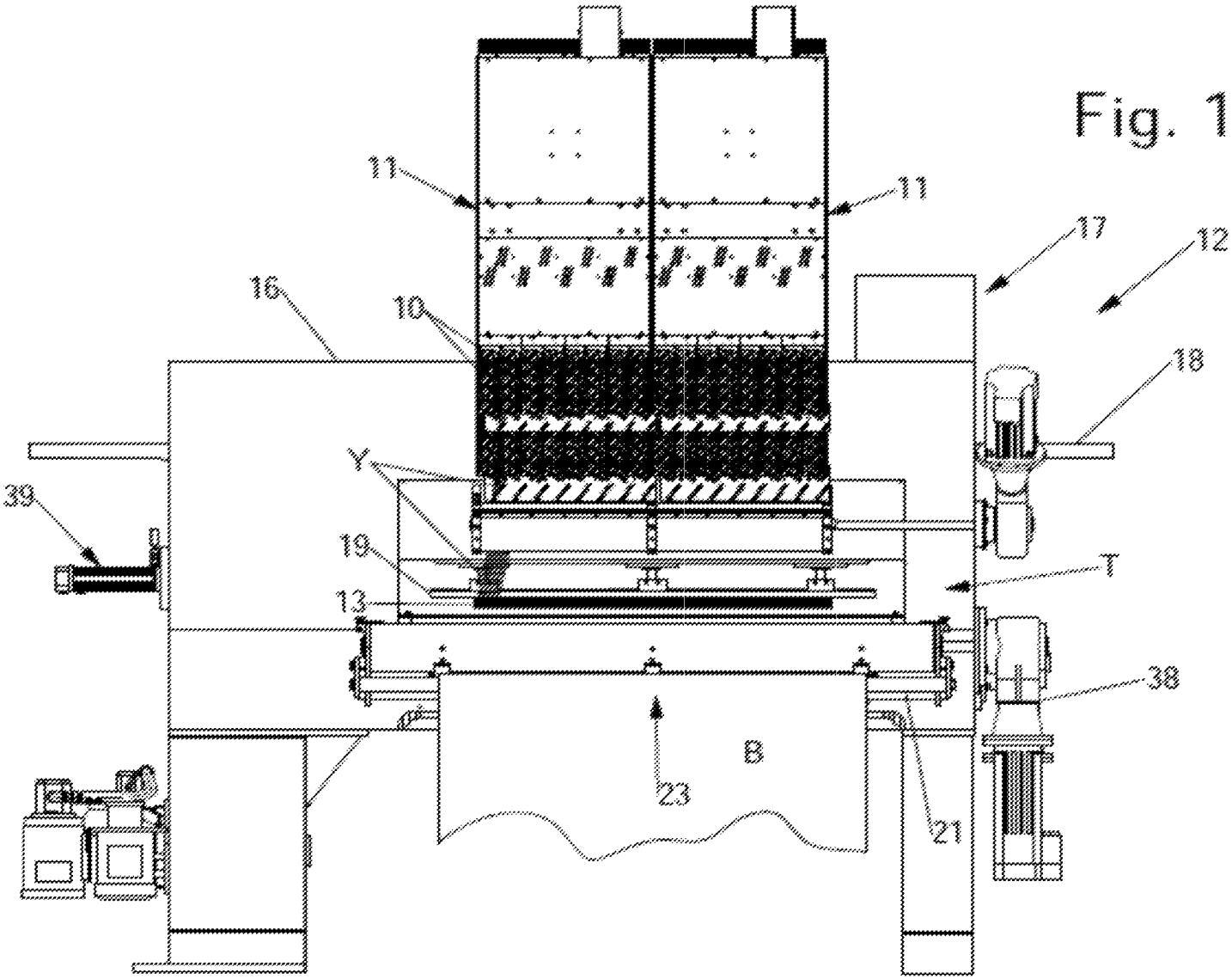

As indicated in FIGS. 1A-1B, the tufting machine 12 generally can comprise a tufting machine such as disclosed in U.S. Pat. No. 8,201,509, the disclosure of which is incorporated by reference as if set forth fully herein, having a frame 16 on which is supported a machine drive motor 17 that drives a main drive shaft 18 (FIG. 1B) so as to reciprocally drive at least one reciprocating needle bar 19 (FIGS. 1A-1B) carrying one or more rows of needles 13 mounted in spaced series therealong. Backing feed rolls 21, including one or more spike rolls 22, feed the backing material B in a direction of feed indicated by arrow 23, through the tufting zone T defined beneath the needles 13 of the tufting machine. By way of illustration and example, FIG. 1A shows a pair of needle bars 19 including in-line rows of needles 13 therealong. However, it will be understood that the present invention can be utilized on essentially any type of tufting machine 12, including tufting machines having a single or multiple needle bars 19 with their needles arranged in-line or in a staggered configuration, and which needle bars also can be shiftable in a transverse direction. As the needle bars are reciprocated, the needles 13 are moved vertically between a raised position out of engagement with the backing material B passing therebeneath, and a lowered, engaging position extending through the backing material and engaging a series of gauge parts 25, such as loop pile loopers, cut pile hooks, level-cut loop loopers, cut/loop clips, or other gauge parts. For example, a series of level-cut loop loopers 26 are shown in FIG. 1A though it will be understood that other types of gauge parts also can be used mounted beneath a bed plate 26 of the tufting machine for the formation of loop and/or cut pile tufts of yarns within the backing material.

As indicated in FIG. 1B, the tufting machine 12 further generally includes a control system 30 including a tufting machine controller or control unit 31, such as disclosed in U.S. Pat. Nos. 5,979,344 and 8,201,509, that monitors and controls the various operative elements of the tufting machine, such as the reciprocation of the needle bars, backing feed, shifting of the needle bars, bedplate position, etc. The machine controller 31 can include a cabinet or work station housing a control computer or processor, and a user interface 32 that can include a monitor 33 and an input device 34, such as a keyboard, mouse, keypad, drawing tablet, or similar input device or system as would be recognized by those skilled in the art. In addition, the monitor could be a touch screen type monitor to enable operator input to the tufting machine controller.

The tufting machine controller 31 generally will control and monitor feedback from various operative or driven elements of the tufting machine, such as receiving feedback from a main shaft encoder 36 for controlling the main shaft drive motor 17 so as to control the reciprocation of the needles, as well as monitoring feedback from the backing feed motors or a backing feed encoder for use in controlling one or more drive motors 38 for the backing feed rolls to control the stitch rate or feed rate for the backing material. A needle sensor or proximity switch also can be mounted to the frame in a position to provide further position feedback regarding the needles. In addition, for shiftable needle bar tufting machines, the tufting machine controller 31 also can monitor and control the operation of one or more needle bar shifter mechanism(s) 39 (FIG. 1B), such as a SmartStep™ shifter as manufactured by Card-Monroe Corp., cam shifter, or other mechanism for shifting the needle bars 19 according to programmed pattern instructions.

The tufting machine control system 30, and the machine controller 31 itself can receive and store such programmed pattern instructions or information for a series of different carpet patterns. These pattern instructions can be stored as a data file in memory at the tufting machine controller itself for recall by an operator, or can be downloaded or otherwise input into the tufting machine controller by the means of a disk, USB drive or other recording medium, direct input by an operator at the tufting machine controller, or from a network server via network connection. In addition, the tufting machine controller can receive inputs directly from or through a network connection from a design center 40 (FIG. 1A). The design center can include a separate or stand-alone design center or work station or computer 41 with a monitor 42 and user input 43, such as a keyboard, drawing tablet, mouse, etc., through which an operator can design and create various tufted carpet patterns, as is known in the art, and/or its functionality could be incorporated with the tufting machine controller.

An operator can create a pattern data file and possibly graphic representations of the desired carpet pattern at the design center computer, which will calculate the various parameters required for tufting such a carpet pattern at the tufting machine, including calculating yarn feed rates, pile heights, backing feed or stitch rate, and other required parameters for tufting the pattern. These pattern data files typically then can be input, downloaded or transferred to the machine controller, or can be stored in memory either at the design center or on a network server for later transfer and/or downloading to the tufting machine controller. Further, the tufting machine controller can be programmed with and can use common Internet protocols (i.e., web browser, FTP, etc.) and have a modem, Internet, or network connections for downloading pattern instructions and/or to enable remote access and trouble shooting.

As shown in FIGS. 1A-1B, the yarn feed drive system 10 of the present invention generally can be a component of or used with each of a series of yarn feed devices 50 for the yarn feed system or attachment 11 that can be constructed as a substantially standardized, self-contained unit or attachment capable of being releasably mounted to and removable from the tufting machine frame 16, and which can be capable of controlling the feeding of single or double ends of yarns (or more yarns) to a selected number or set of needles 13 of the tufting machine. In one example embodiment, the yarn feed unit 11 can comprise yarn feed attachments such as disclosed in U.S. Pat. Nos. 6,834,601 and 8,201,509, the disclosures of which are incorporated by reference as if set forth fully herein. Such a yarn feed unit further can be mounted to a tufting machine as part of a new machine construction or as a retro-fit or conversion in the field, wherein a series of yarn feed units can be selected and removed from an inventory, depending upon the number of needles of the tufting machine, and mounted in series to the tufting machine.

As shown in FIGS. 1A-1B, each yarn feed unit can include a frame 51, having a pair of vertically extending support beams 52, cross-beams or braces 53, and side plates, indicated by phantom lines 54 in FIG. 1A, so as to define a housing or cabinet 56. The housing 56 generally extends upwardly and outwardly from a lower end 57 to an upper end 58 that projects outwardly from the tufting machine frame 16 and lower end 57 of the housing so as to provide the yarn feed unit with a front face or side 59 that extends upwardly at an angle with respect to the rear face or side 61, so as to define an open interior region or space 62 as shown in FIG. 1A. The upper end 58 of the housing can be open or can include a cover, and step plates 64 further can be mounted at spaced positions along the front face 59 of the yarn feed unit so as to define staggered, stepped or offset sections thereof. As indicated in FIGS. 1A-1B, one or more yarn feed units can be mounted to the frame 16 of the tufting machine 11, typically using fasteners such as bolts, screws or other removable fasteners, but also can be welded, riveted or otherwise fixed to the tufting machine frame as desired for more permanent mounting of the yarn feed unit to the tufting machine frame, depending upon the size and/or configuration of the yarn feed units.

As indicated in FIGS. 1A-1B, the yarn feed unit(s) 11 can include a series of yarn feed devices 50, which are received and removably mounted within the housing 56 of the yarn feed unit. The yarn feed devices can be adapted to engage and feed individual yarns to associated needles of the tufting machine for individual or single end yarn feed control, although in some configurations, the yarn feed devices also can be used to feed multiple yarns to selected sets or groups of needles. For example, in a machine with 2,000 needles, each yarn feed unit could control one, two, three, four, or more yarns such that 2,000-500, or fewer, yarn feed units can be used to feed the yarns to the needles. Each yarn feed unit typically can be provided with a pre-determined number or series of yarn feed devices that typically corresponds to some multiple of the needles of the tufting machine, and thus can be manufactured as substantially standardized attachments or units that can be manufactured and stored in inventory for use as needed, without requiring the custom manufacture and assembly of a yarn feed unit of the present invention with the construction of the tufting machine.

Figure 2:
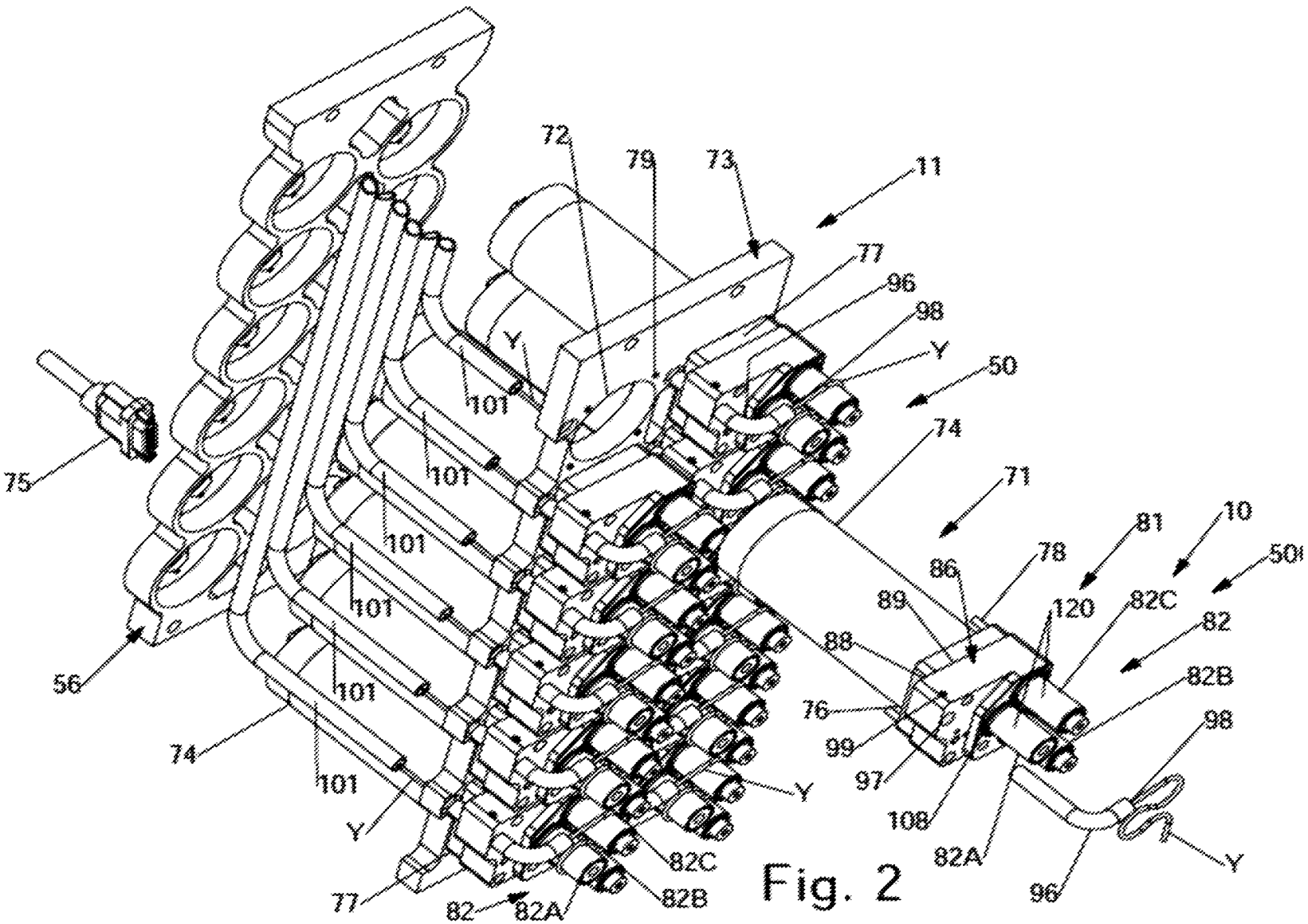
FIG. 2 is a perspective illustration of one embodiment of a yarn feed device incorporating the yarn feed roll drive system or assembly according to the principles of the present invention.

As indicated in FIG. 2, in one example embodiment, each of the yarn feed devices 50 generally includes a drive motor 71 that is received or releasably received within an opening or aperture 72 of a motor mounting plate 73, mounted to the frame of its yarn feed unit, along the front face or side thereof. Each of the yarn feed drive motors generally can comprise a variable speed electric motor, of sufficient desired size and power to be able to exert a substantially constant pulling force on the yarn or series of yarns being fed by the yarn feed devices (e.g., at least about 500-2000 rpm). It also will be understood that a variety of different type and power variable speed electric motors can be used for the drive motors of the yarn feed devices in order to feed a range of yarn sizes (deniers) and types of yarns or other materials that would or could be used in the tufting process, which motors generally will be sufficiently compact in size for use in the yarn feed unit.

The drive motors 71 each will include distal or rear ends 74 (FIG. 3) that are received through the openings of the mounting plates, and to which a cable 75 or other linkage for connection of the motor and yarn feed device to the machine control system, and front or proximal ends 76, which can have a face plate 77 mounted thereto. Each face plate 77 can be formed from a metal such as aluminum or other lightweight, high strength material and also can be formed with a substantially square, rectangular or other configuration so as to overlap the openings 72 (FIG. 2) in the motor mounting plates 73 to limit the extent that the motors will pass through the motor mounting plates. A series of fasteners 78, such as bolts, screws, clips, or other similar removable fastening mechanisms, can be extended through the faceplate 77 of each drive motor 71 and engage corresponding fastener openings or apertures 79 (FIG. 3) within the motor mounting plate 73 for releasably securing the drive motors thereto.

Figure 3:
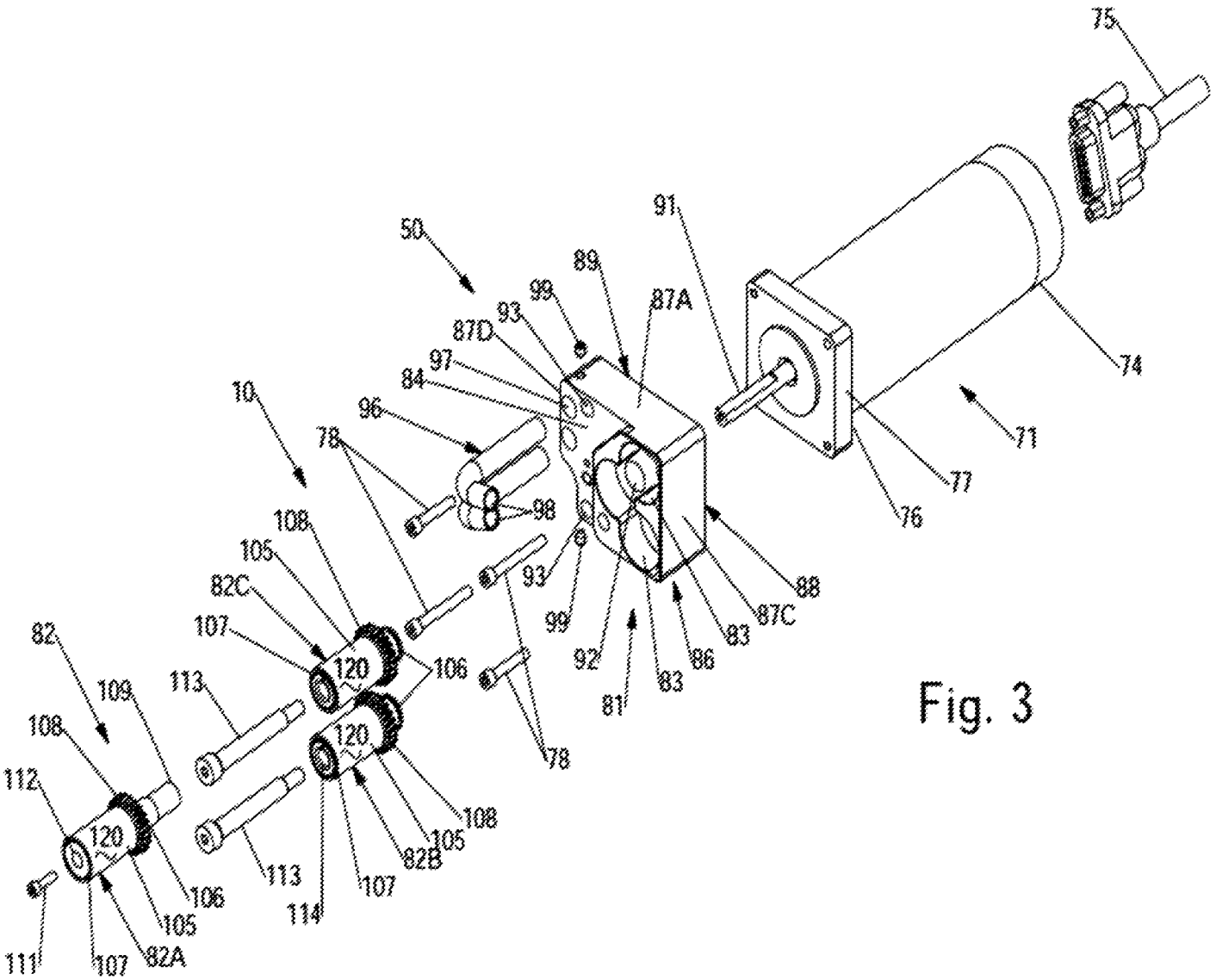
FIG. 3 is an exploded perspective view of a yarn feed device shown in FIG. 2.
Figure 5:
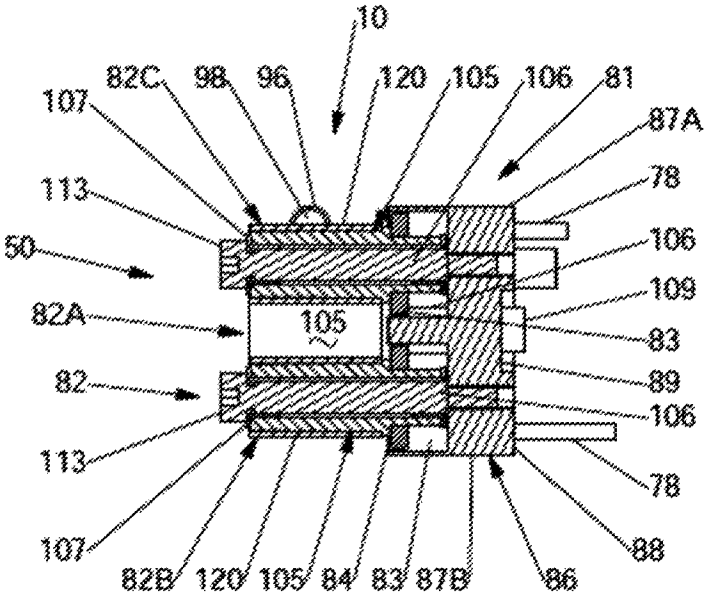
FIG. 5 is a side cross sectional view of the yarn feed roll drive system or assembly of FIGS. 3-4B.

As illustrated in FIG. 3, each of the yarn feed devices 50 further generally will be provided with an associated or corresponding yarn feed roll drive assembly or system 10 formed in accordance with the principles of the present invention. Each yarn feed roll drive assembly or system 10 thus can be integrated with an associated drive motor 71 or otherwise removably mounted in operative engagement therewith as a component or part of an integrated yarn feed device. Each yarn feed roll drive assembly or system 10 further generally will include a housing 81 with a set or series of yarn feed rolls 82 being received within corresponding recesses or cavities 83 defined in a front surface 84 of the housing 81, and being operatively connected to and driven by their associated drive motor for feeding one or more yarns to selected needles of the tufting machine as indicated in FIGS. 1A-1B.

The housing and each of the yarn feed rolls of each drive assembly or system generally can be formed from a lightweight material. For example, an injection molded or extruded composite material, such as a polyvinylchloride (PVC), although other composite, plastic or synthetic materials also can be used, as can various lightweight metal materials, with the selected material(s) having a high strength and rigidity, while being substantially lightweight. The housing and yarn feed rolls preferably can be injection molded or extruded, or can be machined, and can be formed as substantially unitary or one-piece structures. In alternative embodiments, the housings and/or the yarn feed rolls can be composite structures with the elements or parts thereof (i.e., their bodies, the textured surfaces of the rolls, gears/gear teeth, etc. . . . ) formed separately and combined into an assembly. The housing and/or yarn feed rolls also can be formed in varying sizes and/or configurations as needed to accommodate the feeding of various numbers and/or sizes of yarns as well as different types of yarns and/or other materials to be fed by the yarn feed rolls 82 (FIG. 3). The yarn feed roll drive system thus can provide an easily replaceable yarn feed drive system and/or yarn feed device, that can be quickly changed or reconfigured with yarn feed rolls adapted or sized for feeding desired size and/or types of yarns or other materials, and which further can enable the formation of various standard yarn feed roll drive assembly or system designs or configurations. For example, the yarn feed rolls can be removed and replaced with their housings as part of a substantially integrated drive system unit, or simply selected parts thereof, such as the yarn feed rolls, can be replaced as needed.

Figure 4B:
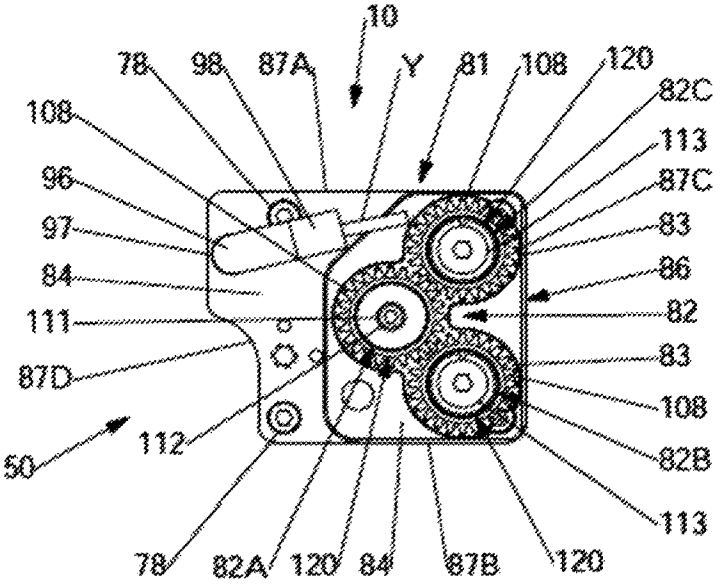
FIG. 4B is a front view of the yarn feed roll drive system or assembly of FIG. 3-4A.

As illustrated in FIGS. 3-4B, the housing 81 generally can include a substantially square or rectangular body 86 having top, bottom and side surfaces 87A-87D, and a series of drive roll recesses 83 formed within its front surface 84. The rear surface 85 of the housing body generally can be substantially flat so that the face plate 77 (FIG. 3) of drive motor 71 is received in abutting contact thereagainst and with the driveshaft 91 of the drive motor being received through a shaft opening 92 formed within one of the drive roll recesses 83 and being engaged by one of the drive rolls 82, as indicated in FIG. 3. Alternatively, in other embodiments, the rear surface 88 of the housing body could be formed with a recess or cavity 89 within which the front plate and/or front end of the drive motor 71 can be received in a generally nested or substantially abutting relationship. Fasteners 78 can be received through fastener openings 93 formed through the housing, and through the face plate of the drive motor, to further secure the drive system housing to its drive motor, in addition to securing the yarn feed device (including the yarn feed motor and yarn feed drive system or assembly 10) to the housing of the yarn feed unit or pattern attachment.

As also shown in FIGS. 3-4B, one or more yarn feed guide tubes 96 further can be received within yarn delivery or feed openings 97 formed in the front surface of the housing body. Each yarn feed guide tube can be an angled or curved tube and can be secured at a desired position with a distal or feed end 98 thereof being aligned at a desired location for feeding one or more yarns to the yarn feed rolls 82. The yarn feed guide tubes also can be secured to the housing such as by set screws or other types of removable fasteners 99. The yarn feed guide tubes 96 further generally will be linked or connected to one or more yarn feed tubes 101 of their yarn feed unit or pattern attachment 11, as indicated in FIG. 2, for receiving and redirecting the yarns toward a path of engagement between the yarn feed rolls.

In the embodiments shown in FIGS. 2-5, a series of three yarn feed rolls 82A-82C generally are used. Each of the yarn feed rolls typically includes an elongated body 105 having a first, rear, base or proximal end 106 and a second, forward, distal or feed end 107. Each of the yarn feed rolls further will include a series of gear teeth 108 mounted about or adjacent its base end 106. The gear teeth 108 can be formed in or can include various configurations or types of teeth, so as to form various type gears, such as spur, helical, spiral, or other gears. The gear teeth also can be formed integrally with the body of their associated yarn feed roll, or can be formed as a separate gear structure received or formed within a recess 83 of the housing 81, over which the body of the yarn feed roll can be mounted or engaged so that the body of each yarn feed roll is rotated by rotation of its associated gear structure. Such an arrangement can enable removal and replacement of the yarn feed roll bodies as needed, without requiring removal and/or separation of the intermeshing engagement of the gear teeth associated therewith.

Figure 4A:
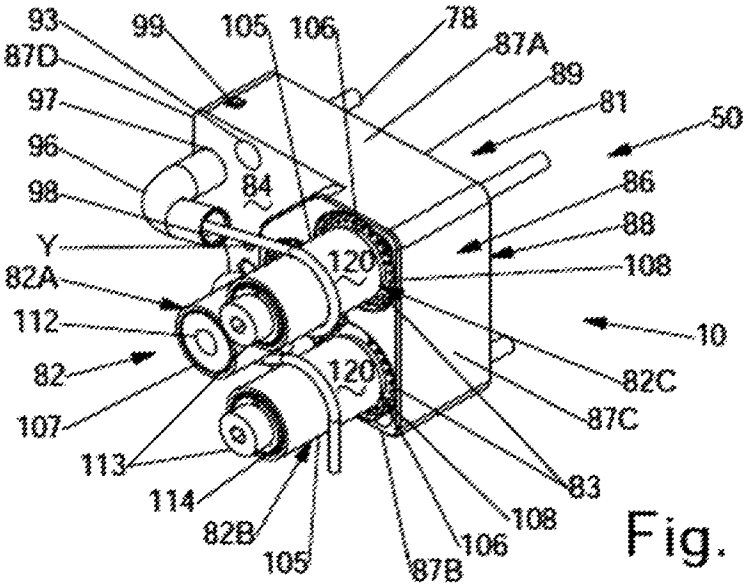
FIG. 4A is a perspective view of the assembled yarn feed roll drive system or assembly of FIGS. 2-3.

As indicated in FIGS. 4A and 4B, when the yarn feed rolls are received with in their respective recesses 83 of the housing 81, the gear teeth 108 thereof will be engaged in an intermeshing relationship, with the yarn feed rolls being substantially rigidly mounted within the housing and projecting forwardly therefrom in a spaced arrangement alignment with the forward portions of the yarn feed rolls generally maintained out of contact with each other. A first one of the yarn feed rolls 82A further can include a rearwardly extending drive shaft or socket 109 adapted to receive and engage the driveshaft 91 of drive motor 71. The drive socket 109 of yarn feed roll 82A can engage the drive motor driveshaft in a substantially frictional engagement, and, in addition, or alternatively, can be further secured to the driveshaft by a fastener 111 received through an opening 112 formed in the forward or distal end 107 of the roll body and which engages and secures the yarn feed roll 82A to the drive motor driveshaft 91.

The additional yarn feed rolls 82B and 82C each generally can be pivotally mounted within their recesses on bushings or shafts 113 received through openings 114 formed therethrough, and will be driven by the engagement of their gear teeth with the gear teeth of the first driven yarn feed roll 82A as it is driven by the drive motor. The bushings 113 can be coated with or manufactured from polytetrafluoride (e.g., Teflon®), an acetyl resin (e.g., Delrin®) or other, similar reduced friction material, and will support the additional, non-drive or idler yarn feed rolls 82B and 82C while enabling substantially free rotation of the drive rolls 82B and 82C thereabout. As indicated in FIGS. 4A-4B, the mounting arrangement of the yarn feed rolls by their bushings, with their gear teeth engaged in an intermeshing relationship, maintains the yarn feed rolls with their forward ends or body portions 107 generally extended in a substantially parallel, spaced relationship. In addition, while the gear teeth/structures of the yarn feed rolls can be formed at a generally 1:1 ratio, in other, alternative embodiments, the gear teeth can be formed at other, varying ratios such that one or more of the yarn feed rolls of each set can have different numbers of teeth. Such an arrangement can enable adjustment of roll surface speeds as needed to provide different levels of tension control of the yarns being fed by varying the ratios of the gear teeth, e.g., the first yarn feed roll can be driven at a first speed and the second and third yarn feed rolls driven at second and/or third, different rates.

As shown in FIG. 4A, the forward ends 107 of the yarn feed rolls are thus separated and maintained out of contact, with the yarns being passed and/or wrapped about the multiple yarn feed rolls, (e.g., extending in a generally serpentine path about the yarn feed rolls). Such an arrangement provides for multiple contact/driving points and/or an increased contact area between the yarn feed rolls and yarns without requiring the yarns to be pinched between the rolls. For example, the up to approximately 90°-180° or more surface contact area between the yarns and their yarn feed rolls can be provided. This increased surface contact defined between the rolls and the yarns helps provide for enhanced traction or pulling of the yarns entwined thereabout while also helping to substantially reduce the load placed thereon as the yarns are fed about the yarn feed drive rolls, and can thus provide for enhanced control of the feeding of the yarns. The arrangement of the yarn feed rolls also does not require the yarn feed rolls to be in biased or spring bearing contact, such as for driving of each of the yarn feed rolls, as well as for pinching and pulling of the yarns therebetween for feeding to the needles. As a result, wearing of the rolls can be reduced by avoiding direct, frictional contact therebetween, and the replacement of the drive rolls further can be facilitated by simple removal of their bearings or support shafts, after which the drive rolls can be quickly and easily changed out.

The arrangement and configuration of the yarn feed rolls of the present yarn feed drive system 10, with the yarn feed rolls being geared together and the yarns entwined or fed thereabout, thus can enable tighter and/or more active, higher control of the feeding of the yarns wrapped and fed thereabout over multiple twist points of the yarns, helping maintain traction and reduce incidence of slipping of the yarns. The yarn feed rolls also are provided with textured roll surfaces 120 that can be replaceably applied or formed along their bodies 105 which provides further increased or enhanced traction or grip of the yarns during pulling or feeding of the yarns by the yarn feed rolls. In one embodiment, the textured roll surfaces of the drive rolls can include a diamond tile coating, such as a Triazact™ diamond tile coating as manufactured by 3M Company, which can be applied during the injection molding process or as an additional step in the formation of the yarn feed rolls so that the textured roll surfaces of the yarn feed rolls are substantially impregnated with the diamond tile or Triazact™ material or coating. In other embodiments, other textured, tacky or enhanced grip materials also can be used. For example, an emery paper or similar abrasive/grit material carrier or sleeve can be applied about the body of each drive roll, and/or the drive rolls can be coated with metalized arc spray or thermal spray coating materials that provide a tacky feel or increased grip. Other materials and/or combinations of such textured, tacky or abrasive gripping materials also can be used, including the use of different materials on different ones of the yarn feed drive rolls.

In operation, as indicated in FIGS. 1A-2, a series of yarns will be fed from a yarn supply, such as a creel, beam, etc., to each of the yarn feed devices of the yarn feed unit or pattern attachment of the tufting machine. Each of the yarns can be fed individually, or in sets or groups of yarns, i.e., two yarns, three yarns, etc., through the one or more yarn feed guide tubes mounted to the front surface of the housing of each yarn feed drive system 10, with the yarns being directed along a path of travel into engagement with the yarn feed rolls 82. The yarns will be wrapped or entwined about the yarn feed rolls, as indicated in FIGS. 2 and 4A, and will be fed thereby to selected ones of the needles of the tufting machine. The operation of each drive motor of each yarn feed device further will be controlled by the tufting machine controller or control system for feeding varying amounts of yarn as needed to form high or low pile tufts or to pull back certain yarns as needed to form various tufted patterns having a variety of pattern features or looks.

As the yarn feed rolls become worn, or if there is a need to change out the yarn feed rolls to feed different yarns (i.e., yarns of a different size or type), the yarn feed rolls can be quickly and easily disengaged from the drive motor and the housing, and thereafter replaced with new yarn feed rolls. For example, in one embodiment, the yarn feed rolls can be directly removed from their associated housings and drive motors, with the removal of their fasteners and/or bushings, after which the yarn feed rolls, or possibly simply the forward body portions thereof, can be replaced with new yarn feed rolls, without necessarily having to remove the housing and/or drive motor from the yarn feed unit or pattern attachment. Alternatively, in other embodiments, such as when the entire set of yarn feed rolls needs to be changed out to utilize other, different or varying size yarn feed rolls, the housing and yarn feed rolls can be removed from their associated drive motor, without having to necessarily remove the drive motor from the yarn feed attachment or unit housing for replacement of the yarn feed rolls, although it will also be possible to remove and replace the entire yarn feed device, including the drive motor, as a unit.

Accordingly, the present invention provides a yarn feed roll drive system or assembly that can enable the efficient and easy change out or removal of yarn feed rolls as needed from a pattern attachment or yarn feed unit of a tufting machine, without necessarily having to replace or remove associated drive motors, and which yarn feed rolls can be formed from lower cost materials by injection molding, extruding or similar processes and which thus can be formed in varying sizes or configurations as needed for feeding different size or configuration or material yarns. The yarn feed roll drive system further provides a yarn feed roll construction and arrangement that provides for multiple points of contact of the yarns being fed thereby, thus enabling enhanced traction and control of the feeding of yarns thereby.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A tufting machine, comprising:

backing feed rolls feeding a backing material through the tufting machine;

a series of needles driven in a reciprocating motion into and out of the backing material; and at least one yarn feed unit mounted to the tufting machine and feeding a series of yarns to the needles, the at least one yarn feed unit comprising a housing with a series of yarn feed devices received therein, each yarn feed device having a drive motor operatively connected to a yarn feed roll drive assembly that includes a set of yarn feed rolls about which a selected number of yarns are fed;

wherein each of the yarn feed rolls of each yarn feed roll drive assembly comprises a body having a rear portion including a series of gear teeth, with the gear teeth of each of the yarn feed rolls of each yarn feed roll drive assembly in intermeshing engagement, and a forward portion projecting forwardly from the gear teeth, the forward portion of each of the yarn feed rolls being maintained substantially out of contact with each other such that the yarns being fed thereby are extended about the forward portions of each of the yarn feed rolls without being pinched therebetween wherein the drive motors of the yarn feed devices are controlled so as to drive at least one of the yarn feed rolls of the yarn feed roll drive assembly operatively connected thereto, with other yarn feed rolls of the yarn feed roll drive assembly driven by the intermeshing engagement of the gear teeth thereof with the gear teeth of the at least one yarn feed roll driven by the drive motor for feeding the yarns to the needles.

2. The tufting machine of claim 1, wherein each set of yarn feed rolls comprises of each yarn feed roll drive assembly three yarn feed rolls each formed from a lightweight plastic material.

3. The tufting machine of claim 1, wherein the forward portion of each yarn feed roll comprises a textured roll surface comprising at least one of a diamond tile coating material, an abrasive/grit carrier material, an emery paper material, a metalized arc spray, or a thermal spray coating material.

4. The tufting machine of claim 1, wherein each set yarn feed roll drive assembly further comprises a housing removably mountable to the drive motor, and wherein the set of yarn feed rolls of each yarn feed roll drive assembly is removably mountable within the housing.

5. The tufting machine of claim 4, wherein the housing and yarn feed rolls of each yarn feed roll drive assembly comprise a lightweight injection molded or extruded material.

6. The tufting machine of claim 4, wherein the set of yarn feed rolls of each yarn feed roll drive assembly comprises three yarn feed rolls received within a recess formed within the housing, with the gear teeth of each yarn feed roll received in intermeshing engagement such that the yarn feed rolls are driven together by the driving of the at least one yarn feed roll by the drive motor.

7. The tufting machine of claim 1, wherein each set of yarn feed rolls of each yarn feed roll drive assembly comprises three yarn feed rolls, and each yarn feed roll drive assembly further comprises a housing mountable over the drive motor and having a front facing recess in which the yarn feed rolls are received with the gear teeth of each of the yarn feed rolls in intermeshing contact, and wherein each yarn feed drive roll assembly is removable from its drive motor as a unit.

8. A system for feeding yarns to the needles of a tufting machine, comprising:

at least one yarn feed unit; and a series of yarn feed devices received within the yarn feed unit, the yarn feed devices comprising:

a drive motor; and a yarn feed roll drive assembly including a series of yarn feed rolls each comprising a body formed from a lightweight material and having a forward portion about which one or more yarns are passed and a rear portion wherein the forward portions of the yarn feed rolls of each yarn feed roll drive assembly project forwardly in a spaced apart arrangement substantially out of contact with the forward portions with other ones of the yarn feed rolls and configured to enable approximately 90 degrees of contact between the forward portions of the yarn feed rolls and one or more yarns extended thereabout, wherein the drive motor of each yarn feed device drives at least one of the yarn feed rolls, the rotation of which drives rotation of the other yarn feed rolls such that the one more yarns extended about the forward portions of each of the yarn feed rolls are drawn thereabout and fed to the needles of the tufting machine without being pinched between the yarn feed rolls.

9. The drive system of claim 8, wherein the forward portion of each yarn feed roll includes a textured surface comprising at least one of a diamond tile coating material, an abrasive/grit carrier material, an emery paper material, a thermal spray coating, or a metalized arc spray material.

10. The drive system of claim 8, wherein the yarn feed rolls of each yarn feed roll drive assembly are received within a housing removably mountable to the drive motor, and wherein the yarn feed rolls are removable with the housing as a unit.

11. The drive system of claim 8, wherein each of the yarn feed rolls comprises a textured surface along the forward portions thereof and a series of gear teeth at the rear portion of the body thereof, and wherein the yarn feed rolls each are received within a recess formed within a housing mountable to the drive motor with the gear teeth of each yarn feed roll in intermeshing engagement such that the yarn feed rolls are rotated together by the driving of the at least one yarn feed roll by the drive motor.

12. The drive system of claim 11, wherein the textured surface and the gear teeth of each of the feed rolls comprise replaceable components releasably mountable along the body of each yarn feed roll.

13. The drive system of claim 8, wherein each yarn feed roll drive assembly comprises a set of three yarn feed rolls each having a series of gear teeth arranged at the rear portion thereof, and wherein each of the yarn feed rolls are received within a recess formed within a housing, with the yarn feed rolls arranged in a staggered or offset arrangement and with the gear teeth of adjacent yarn feed rolls in driving engagement such that each of the yarn feed rolls is rotated in response to the driving of the at least one yarn feed roll by the drive motor.

14. The drive system of claim 13, wherein each yarn feed roll of the set of yarn feed rolls can have a different number of gear teeth so as to cause the yarn feed rolls to be driven at different rates.

15. The drive system of claim 8, wherein the body of each yarn feed roll comprises a molded or machined structure substantially integrally formed with its textured surface and with a series of gear teeth at a first end thereof so as to define a substantially unitary yarn feed roll.

* * * * *